US005743837A

United States Patent [19]

Dias et al.

[11] Patent Number: 5,743,837

[45] Date of Patent: Apr. 28, 1998

[54] BODY MOUNTED MUSCLE EXERCISE DEVICE AND METHOD

[75] Inventors: Joseph A. Dias, Toronto, Canada; Tory Allman, Laguna Niguel, Calif.; John T. Loechner, Westport, Conn.; John R. Nottingham, Hunting Valley, Ohio

[73] Assignee: Laurcath Corporation, Solana Beach, Calif.

[21] Appl. No.: 506,424

[22] Filed: Jul. 24, 1995

[30] Foreign Application Priority Data

Nov. 1, 1994 [CA] Canada ..... 2134852

[51] Int. Cl.[6] ..... A63B 21/02

[52] U.S. Cl. ..... 482/124; 482/51; 482/121; 482/139

[58] Field of Search ..... 482/121, 124, 482/122, 74, 131, 139, 51, 148; 601/33–35; 602/16, 23

[56] References Cited

U.S. PATENT DOCUMENTS

| | | | |
|---|---|---|---|
| 2,111,018 | 3/1938 | Ahler | 602/16 |
| 2,267,848 | 12/1941 | Taylor | 602/16 |
| 2,778,358 | 1/1957 | Keles | 602/16 |
| 4,697,808 | 10/1987 | Larson et al. | 482/51 |
| 4,784,121 | 11/1988 | Brooks | 601/34 |
| 4,838,249 | 6/1989 | Jannotta | 601/23 |
| 5,462,518 | 10/1995 | Hatley et al. | 482/124 |
| 5,465,428 | 11/1995 | Earl | 482/124 |

FOREIGN PATENT DOCUMENTS

| | | | |
|---|---|---|---|
| 820855 | 4/1981 | U.S.S.R. | 482/74 |
| 2098490 | 11/1982 | United Kingdom | 602/16 |

*Primary Examiner*—Jeanne M. Clark
*Attorney, Agent, or Firm*—Baker, Maxham, Jester & Meador

[57] ABSTRACT

This invention provides a body mounted exercise device primarily for use in exercising the muscles of the buttocks, but preferably adaptable to also exercise the thighs and arms. The device preferably comprises two hinge plates which are each secured outwardly and to one side of a respective hip joint of a human user, each of the hinge plates provided with a pivot arm pivotable about the hinge plate. For exercise of the muscles of the buttocks, the pivot arms extend downwardly along the legs of the user, preferably engaging the backs of the legs between the hip joints and knees. The exercise device is provided with biasing means which exert a forwardly directed biasing force on the backs of the legs, the biasing force opposing rearward pivoting of the legs about the hip joints. During rearward pivoting of the legs, the muscles of the buttocks contract and are forced to overcome the biasing force exerted by the pivot arms on the legs of the user. Thus, the exercise device of the present invention provides a simple and effective means of exercising the buttocks, and can be used during normal walking motion of the user. The method of exercising muscles using the disclosed apparatus is part of the invention.

13 Claims, 5 Drawing Sheets

BODY MOUNTED MUSCLE EXERCISE DEVICE AND METHOD

FIELD OF THE INVENTION

This invention relates to a body mounted muscle exercise device for humans which is particularly useful for exercising the muscles of the buttocks, to assist in firming and shaping these muscles.

BACKGROUND OF THE INVENTION

Numerous types of exercise devices are available for exercising various muscles of the human body. For example, stationary weight machines and free weights can be used to firm, shape and increase the size of arm and leg muscles. Other body mounted devices are available for firming and shaping thigh muscles. However, the disadvantage exists that certain muscles of the human anatomy are difficult to isolate and exercise using currently known methods and equipment, whether body mounted or stationary.

For example, it is difficult to isolate the muscles of the buttocks region during exercise and no body mounted devices currently exist specifically directed to exercising the muscles of this region.

SUMMARY OF THE INVENTION

To at least partially overcome the disadvantages of previous muscle exercise devices and exercise methods, the present invention provides a body mounted muscle exercise device which exercises the muscles of the buttocks region and a method of exercising using such a device. The exercise device is also adaptable for use in the exercise of other muscles, such as arms and thighs.

The inventors have developed a body mounted muscle exercise device which exercises the muscles of the buttocks, comprising a hinge plate to be positioned at or near a hip joint of a human user with a pivot arm pivoting on the hinge plate and extending from the hinge plate along a leg of the user. The pivot arm follows the rearward and forward pivoting of the leg about the hip joint, being biased to oppose rearward pivoting of the leg about the hip joint, during which the muscles of the buttocks contract.

During rearward pivoting of the leg about the hip joint, the exercise device forces the muscles of the buttocks to work harder to pivot the leg rearwardly against the forwardly biased pivot arm. Thus, the device effectively isolates and exercises the muscles of the buttocks, helping to firm and shape them.

The exercise device of the present invention can be adapted for use as a thigh exerciser by reversing the bias of the pivot arm to oppose forward pivoting of the leg.

The exercise device of the present invention can also be used to exercise muscles of the arms. For example, the pivot arm could be adapted to follow movement of the forearm about the elbows.

It is one object of the present invention to provide a body mounted muscle exercise device for humans which exercises the muscles of the buttocks.

It is another object of the present invention to provide a method of exercising the buttocks by using a body mounted exercise device according to the present invention.

It is yet another object of the present invention to provide a body mounted exercise device capable of exercising the buttocks, thighs and arms.

It is yet another object of the present invention to provide a method of exercising the arms using a body mounted exercise device according the the present invention.

It is yet another object of the present invention to provide a method of exercising the thighs using a body mounted exercise device according to the present invention.

In one of its aspects, the present invention provides a muscle exercise device which provides resistance to rearward pivoting of a leg about its hip joint, the device comprising a hinge plate and pivot arm assembly, a mechanism to secure the hinge plate to the user, and a biasing mechanism to forwardly bias the pivot arm to resist rearward pivoting of the leg.

The pivot arm has two ends, a first end and a second end. The first end is secured to the hinge plate for pivoting relative to the hinge plate about a pivot axis. The pivot arm extends from this first end, along the leg of the user, to its second end, which carries an engagement mechanism for engagement of the leg between the hip joint and knee.

The securing mechanism holds the hinge plate in place outwardly and to one side of the user's hip joint with the pivot axis preferably substantially parallel to a hip axis extending centrally through both hip joints of the user. The securing mechanism also retains the hinge plate against pivoting about the hip axis.

The biasing mechanism urges the pivot arm to pivot about the pivot axis, with the second end of the pivot arm being urged to move forwardly, so that rearward pivoting of the leg about the hip joint pivots the pivot arm against the bias of the biasing mechanism.

In another aspect, the present invention provides a method of exercising the muscles of the buttocks, which comprises rearwardly pivoting a leg about a hip joint in opposition to a forwardly directed force exerted on the leg between the hip joint and knee, the forwardly directed force being produced by an exercise device according to the present invention.

A preferred exercise device according to the present invention is a body mounted device secured to the body of the user with the hinge plate outwardly and to one side of the hip joint. It is preferred that the device be light weight so it can be comfortably worn on the user's body.

The device can be used in a number of ways to exercise the buttocks. However, the preferred mode of exercising using the device of the present invention is by normal walking, which produces the desired rearward pivoting of the leg about the hip joint. Walking is preferred because it is simpler and less strenuous then some exercises and can be done while the user is performing other activities, such as housework.

Although the exercise device of the present invention is used for exercising the muscles of the buttocks, it is preferred that it be adaptable to use in the exercise of other muscles, such as the thighs and arms. The ability to perform a variety of exercises makes the device of the present invention particularly well suited for physical therapy, which generally involves strengthening a number of different muscle groups.

The preferred device of the present invention, described above as a buttocks exerciser, is easily modified to become an effective thigh exerciser. To be used as a thigh exerciser, the bias of the biasing mechanism is simply reversed to oppose forward pivoting of the leg about the hip joint.

To be used as an arm exerciser, the hinge plate is preferably secured at or near the hip joint as described above. The biasing mechanism is preferably adapted to oppose movement of the forearm about the elbow, both toward the chest (bending the elbow) and away from the chest (straightening the elbow).

Although an exercise device according to the present invention may be provided with one hinge plate, it is preferable to provide a device having two hinge plates, each of which is secured outwardly and to one side of one hip joint of the user. This allows both sides of the buttocks, both thighs, or both arms to be exercised simultaneously.

In a preferred body mounted device having two hinge plates, it is preferred that the securing mechanism comprises a securing mechanism comprising a rigid U-shaped harness comprising a central bight located between the two ends of the harness. In this device, one hinge plate is attached to each end of the harness, with the central bight curving around the user's lower back. The rigidity of the harness helps to keep the hinge plates from moving during pivoting of the legs about the hip joints.

To further improve stability of the preferred exercise device of the present invention, the device is preferably provided with an upward extension on the central bight which engages the user's lower back, the extension on the bight being attached to a belt worn around the user's waist. Preferably, the belt is also attached by adjustable straps to each of the hinge plates. The combination of the extension on the central bight and the straps between the belt and hinge plates provides sufficient stability to the hinge plates, preventing them from moving during pivoting of the legs.

It is preferred that the pivot arms extend down the sides of the user's legs to the second ends of the pivot arms, which curve rearwardly and are preferably provided with an engagement mechanism in the form of hooks which extend laterally inwardly from the second end of the pivot arm and each engage the rear of one of the user's legs between the hip joint and knee. It is through the hooks that the forward biasing force is exerted on the user's legs, and it is also the hooks which are pushed rearwardly to pivot the pivot arm against the biasing force when the user's legs are pivoted rearwardly about their hip joints.

The biasing mechanism is preferably disposed between the hinge plate and the first end of the pivot arm, and may comprise either a spring or a resilient elastic band. An elastic band is preferred due to its ease of replacement. The elastic band is preferably stretched at least to some degree during the entire range of movement of the user's leg forwardly and rearwardly, so that the hooks on the second end of the pivot arm remain engaged with the user's leg throughout the range of forward and rearward movement of the leg about the hip joint.

BRIEF DESCRIPTION OF THE DRAWINGS

Further aspects and advantages of the present invention will become apparent from the following description, taken together with the accompanying drawings, in which.

DETAILED DESCRIPTION OF THE PREFERRED EMBODIMENTS

A preferred embodiment of the muscle exercise device of the present invention, as used for exercising the muscles of the buttocks, is now described with reference to FIGS. 1 to 5.

Figure 1:
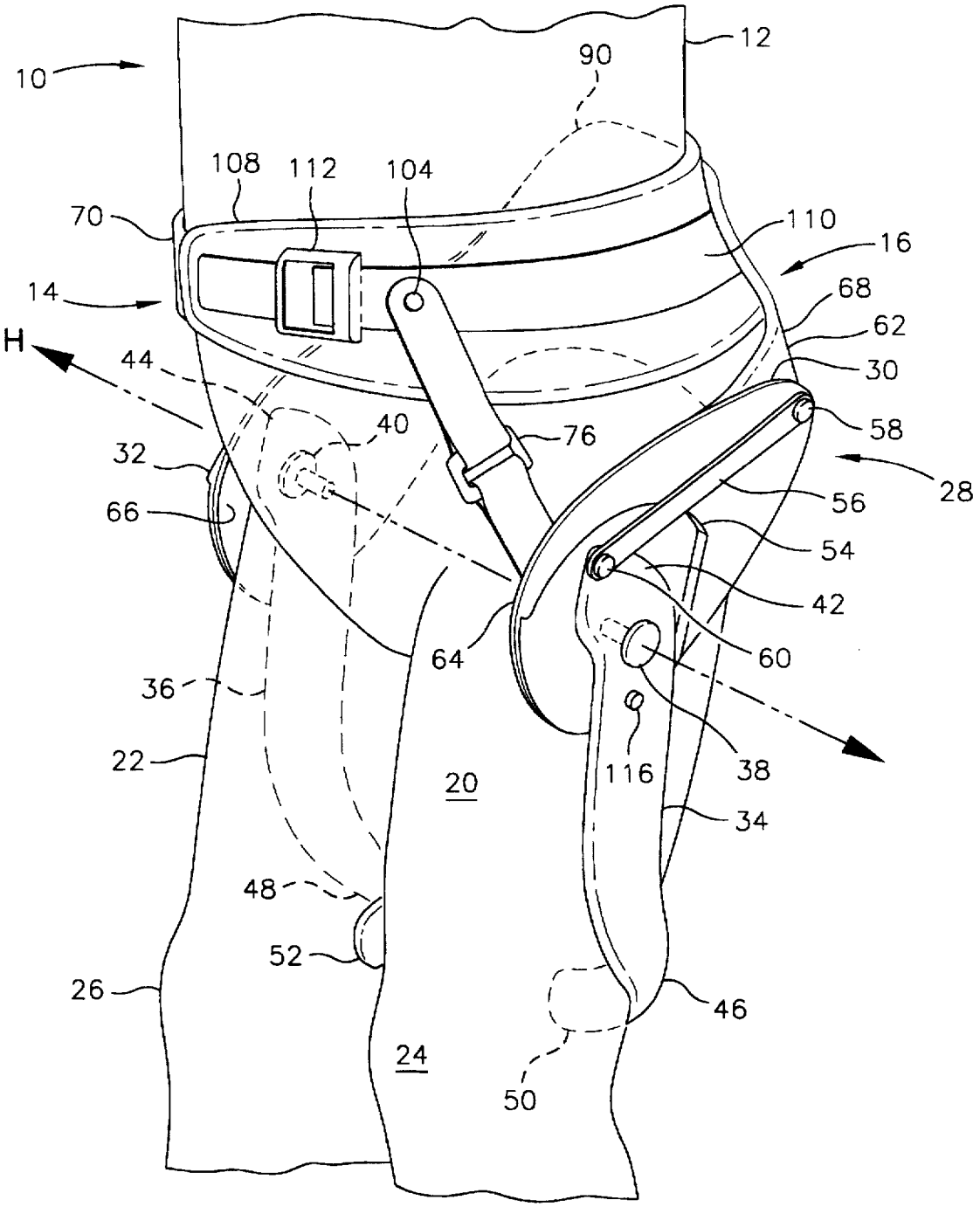
FIG. 1 is a front perspective view of an exercise device of the present invention as worn by a human user.

FIG. 1 illustrates a human user 10 having a torso 12, waist 14, lower back 16, buttocks 18, left leg 20, right leg 22, left knee 24 and right knee 26.

Figure 5:
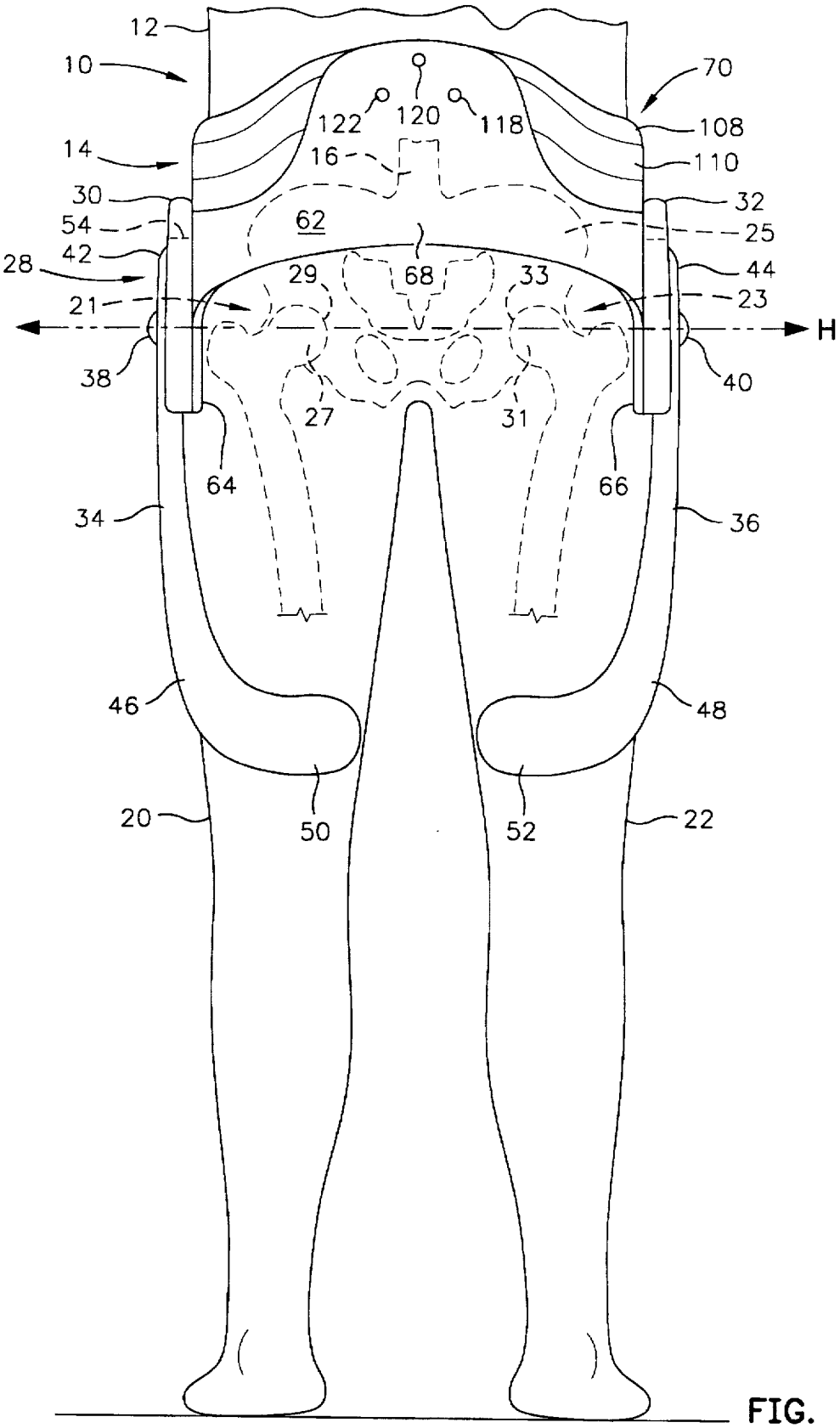
FIG. 5 illustrates a rear view of the device of FIG. 1 as worn by a human user and shows the skeletal structure of the user's pelvic region.

FIG. 5 illustrates the skeletal structure of the pelvic region of user 10. Shown are a left hip joint 21 at the upper end of left leg 20 and a right hip joint 23 at the upper end of right leg 22. The hip joints 21 and 23 join legs 20 and 22 to pelvic bone 25. Both of these hip joints 21 and 23 comprise a ball and socket joint. In left hip joint 21, ball 27 rotates in socket 29 during pivoting of left leg 20. Similarly, ball 31 rotates in socket 33 during pivoting of right leg 22 about right hip joint 23.

FIGS. 1 and 5 illustrate a hip axis H of the user 10. This hip axis H is defined as passing centrally through both hip joints 21 and 23 of the user 10 and is also the axis about which each leg 20 or 22 pivots forwardly and rearwardly about its corresponding hip joint 21 or 23.

As shown in FIG. 1, secured to the user 10 is a preferred body mounted muscle exercise device 28 according to the present invention having a left hinge plate 30 and a right hinge plate 32. The left hinge plate 30 is positioned outwardly and to the left side of the left hip joint 21 (not shown in FIG. 1) of user 10. Similarly, the right hinge plate 32 (shown in rear view FIG. 5) is positioned outwardly and to the right side of the right hip joint (not shown) of the user 10. The terms "left" and "right", as used herein, are defined as they would be by a user 10 wearing the device 28.

As shown in FIG. 1, a left pivot arm 34 is secured to the left hinge plate 30 for pivoting relative to the left hinge plate 30. The corresponding right pivot arm 36 is secured to the right hinge plate 32 for pivoting relative to the right hinge plate 32.

As shown in FIG. 1, left hinge plate 30 is provided with outwardly extending flange 54. Right hinge plate 32 is provided with a similar flange (not shown). Flange 54 preferably limits the degree of rotation of pivot arm 34. For example, in device 28, flange 54 limits the forward pivoting of pivot arm 34. Preferably flange 54 allows pivot arm 34 to engage leg 20 throughout substantially its entire range of forward and rearward motion.

The first end 42 of the left pivot arm 34 is secured to the left hinge plate 30 by means of pivot pin 38, which is attached to left hinge plate 30. A similar arrangement exists at the right hinge plate 32, with the first end 44 of the right pivot arm 36 being secured to right hinge plate 32 by means of a pivot pin 40 which is attached to the right hinge plate 32.

The axes of rotation of the arms 34 and 36 about the respective pivot pins 38 and 40 are preferably substantially parallel to the hip axis H. More preferably, the axes of rotation of arms 34 and 36 are substantially coincident with the hip axis H, the hip axis H passing substantially centrally through pivot pins 38 and 40.

As shown in FIG. 1, the left pivot arm 34 preferably extends from its first end 42 on left hinge plate 30 along the side of left leg 20 to its second end 46. FIG. 1 illustrates that the second end 46 of pivot arm 34 preferably curves rearwardly from the side of leg 20 toward the rear of leg 20. The second end 46 of left pivot arm 34 carries an engagement hook 50 extending laterally inwardly from second end 46 and engaging the rear of the left leg 20 between the left hip joint 21 of user 10 and the left knee 24. The engagement of the hook 50 is more clearly shown in the rear view of FIG. 5.

Although not shown in FIG. 1, the right pivot arm 36 preferably extends from first end 44 on the right hinge plate 32 along the side of the right leg 22 to its second end 48, which preferably curves rearwardly in a fashion similar to the second end 46 of left pivot arm 34. The second end 48 of right pivot arm 36 carries an engagement hook 52 extending laterally inwardly from second end 48 to engage the rear of right leg 22 between the right hip joint 23 and right knee 26.

Although the preferred embodiment of device 28 shown in the drawings engages the user's legs 20 and 22 by means of engagement hooks 50 and 52, other types of engagement mechanisms may be used. For example, the second ends 46 and 48 of the pivot arms 34 and 36 may each carry an engagement mechanism in the form of a cuff which extends completely around the leg 20 or 22.

Although the following discussion focuses primarily on the left side of device 28, it is to be understood that the right side of device 28 operates in an identical fashion.

In order to exercise the muscles of the left side of the buttocks, the left pivot arm 34 must be forwardly biased, so that the second end 46 of left pivot arm 34 is urged to move forwardly with the engagement hook 50 exerting a forwardly directed force against the back of left leg 20. To provide this forward force, a biasing mechanism is provided to urge the left pivot arm 34 to pivot about the hinge plate 30.

Although many different types of biasing mechanisms may be employed, FIGS. 1 to 4 illustrate a particularly preferred biasing mechanism comprising a resilient elastic band 56 extending between a support pin 58 located on the hinge plate and a support pin 60 located on the first end 42 of the left pivot arm 34. In FIG. 5, the biasing mechanism is not shown. However, it is to be understood that the device 28 shown in FIG. 5 has the same biasing mechanism as that shown in FIGS. 1 to 4.

Other types of biasing mechanisms may also be used, such as a coil spring acting on first end 42 of pivot arm 34 or a torsion spring positioned around pivot pin 38 on the underside of pivot arm 34.

However, it is preferred that the user be able to adjust the amount of biasing force so that the device 28 is suitable for different users having different levels of fitness. The use of elastic band 56 as shown in FIG. 1 is particularly preferred since it permits the easy substitution of another elastic band. In this way, the user 10 may substitute other elastic bands requiring different amounts of force to cause them to stretch. The higher the amount of force required to stretch the elastic band, the greater the biasing force exerted on leg 20 by the engagement hook 50.

In FIG. 1, the user 10 is shown in the standing position. In this position, the elastic band 56 is in a partially stretched state, so that a biasing force is being exerted on the back of leg 20 by pivot arm 34. It is preferred that the biasing force is exerted against the back of leg 20 throughout the normal range of forward and rearward motion of leg 20, particularly while the user is walking or standing, so that the hook 50 engages the back of leg 20 throughout substantially its entire range of forward and rearward pivoting about the left hip joint 21.

In order to benefit from the device, it is preferred that hinge plates 30 and 32 be securely held in place outwardly and to one side of the hip joints 21 and 23 of the user 10. Further, it is preferred that the hinge plates 30 and 32 be retained with their respective pivot axes substantially parallel to the hip axis H. However, it is to be understood that it is not necessary that the pivot axes be parallel to the hip axis for the user 10 to derive a benefit from the device 28.

It is more preferred that the pivot axes be substantially coincident with the hip axis H, in which case the axes of rotation of the pivot arms 34 and 36 about hinge plates 30 and 32 will be substantially identical to the axis of forward and rearward rotation of legs 20 and 22 about their respective hip joints 21 and 23. When the pivot axes are substantially coincident the hip axis H, maximum benefit may be derived from device 28 and engagement hooks 50 and 52 will not move along legs 20 and 22 as pivot arms 34 and 36 pivot about the pivot axes. Rather, engagement hooks 50 and 52 will remain engaged at the same locations on the backs of legs 20 and 22, enhancing the comfort of user 10.

The user 10 may also derive a substantially full benefit from use of device 28 when the pivot axes are substantially parallel to hip axis H, but not coincident with axis H. However, it is preferred that pivot axes be as close as possible to being coincident with hip axis H to achieve maximum comfort and benefit for the user 10.

Therefore, it is preferred to secure the hinge plates 30 and 32 to the user 10 so that the pivot axes are substantially parallel to hip axis H, and to retain the hinge plates 30 and 32 in this position. This can be accomplished in any number of ways. In the preferred exercise device 28 shown in FIGS. 1 to 5, this securing and supporting the hinge plates 30 and 32 is accomplished by means of a harness 62 and a belt 70, which are most clearly shown in the exploded view of FIG. 2.

Figure 2:
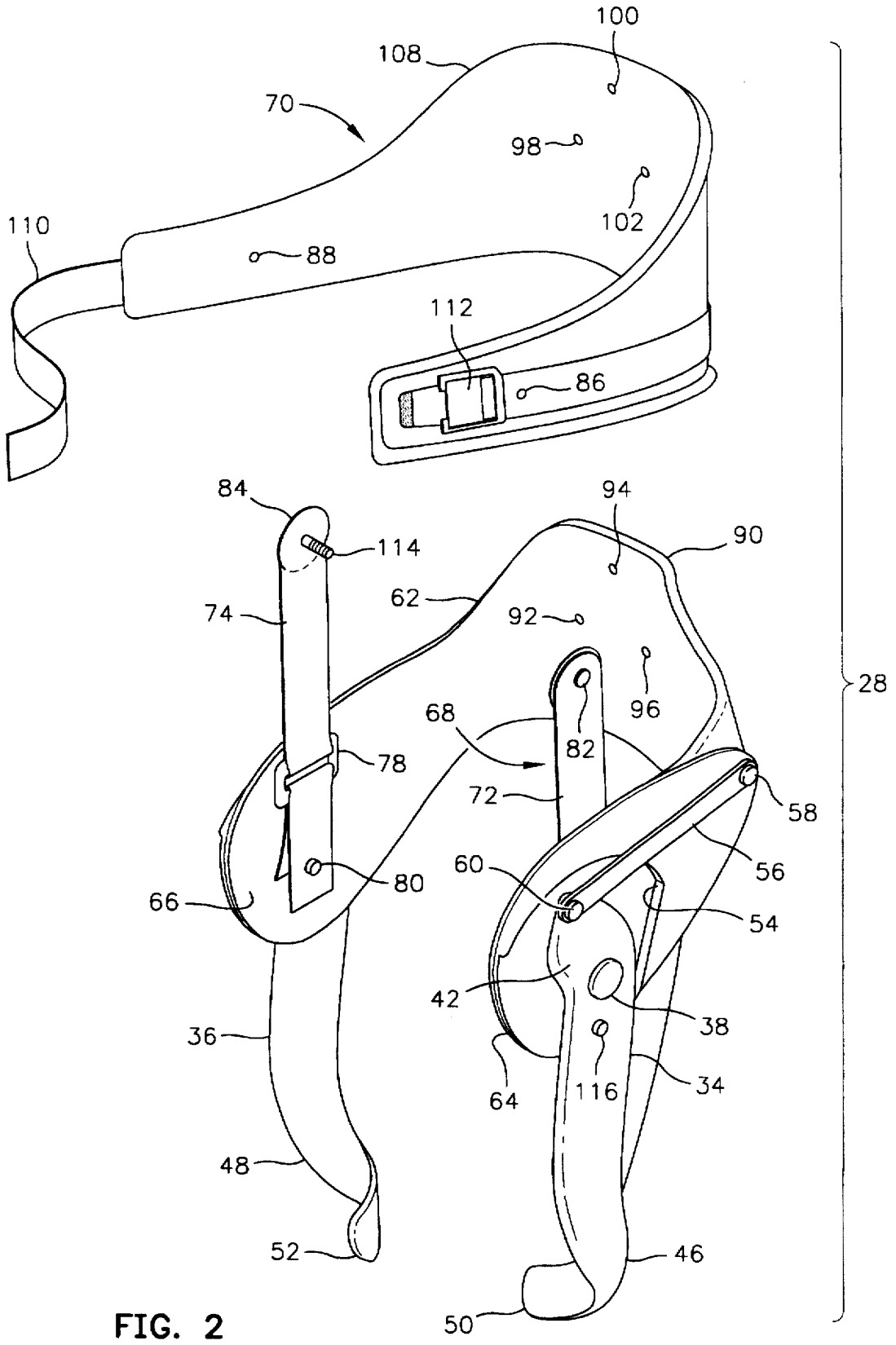
FIG. 2 is a front, exploded, perspective view of the exercise device of FIG. 1.

As shown in FIG. 2, the harness 62 is preferably U-shaped, comprising a left end portion 64 and a right end portion 66 connected by a central bight between the ends 64 and 66. Left hinge plate 30 is rigidly attached to the left end 64 of harness 62, while right hinge plate 32 (not shown in FIG. 2) is rigidly attached to the right end 66 of harness 62.

The hinge plates 30 and 32 may either be integrally formed as part of harness 62 or may be separately formed and then rigidly secured to the ends 64 and 66 by any suitable method of attachment, including glue, bolts, rivets, snap fasteners, or any combination thereof. The particular method of securing the hinge plates 30 and 32 is unimportant as long as the hinge plates 30 and 32 are substantially prevented from moving relative to the ends 64 and 66 of harness 62.

The harness 62, hinge plates 30 and 32, and pivot arms 34 and 36 are preferably made from a rigid thermoplastic material.

Figure 3:
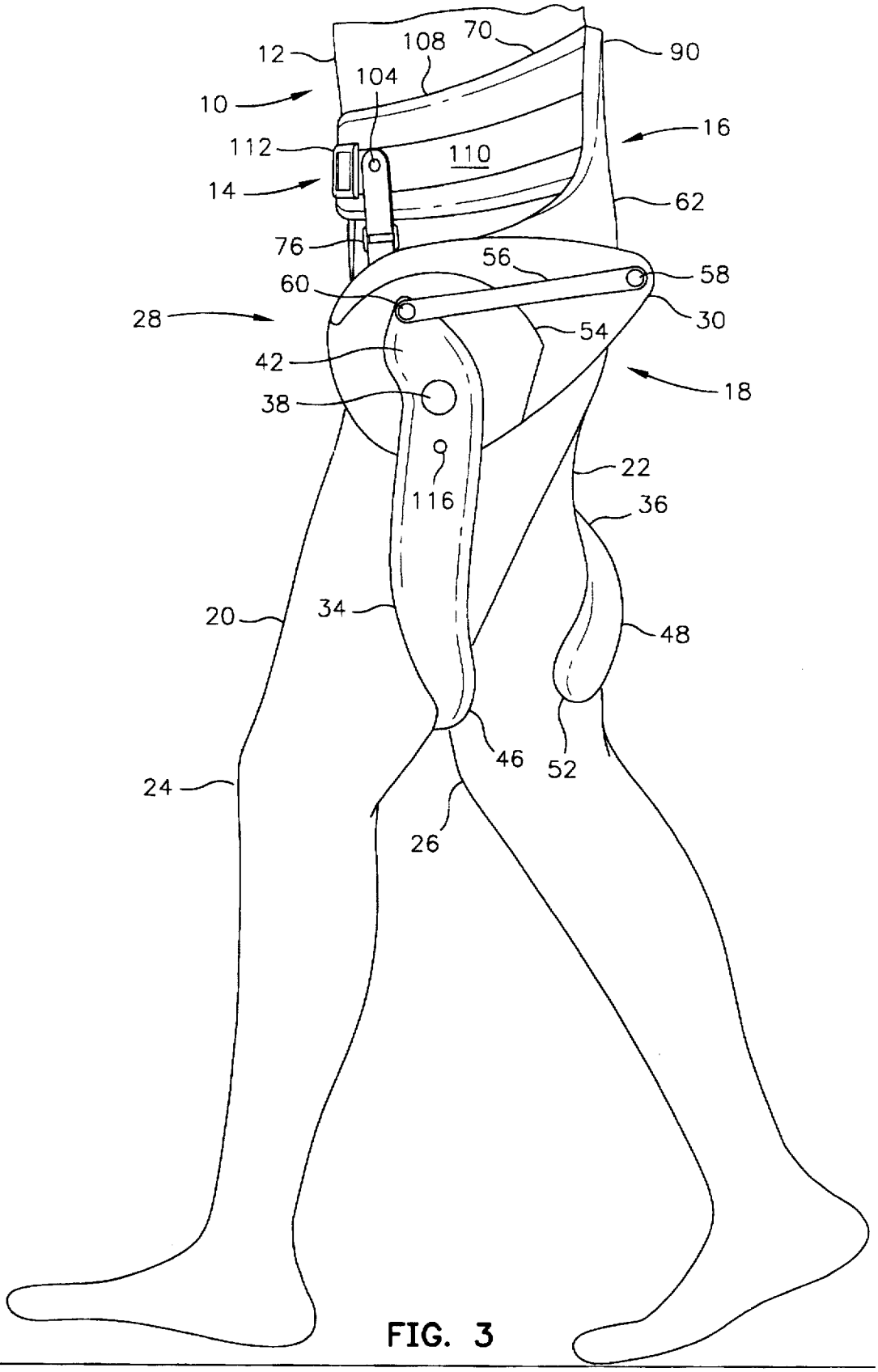
FIG. 3 is a side view illustrating the device of FIG. 1 worn by a human user, the left leg of the user being at a first position during normal walking motion.

The harness 62 is secured to the user with the ends 64 and 66 located outwardly and to one side of the hip joints 21 and 23 respectively, of the user 10. The central bight 68 curves around the lower back 16 of user 10. Since the lower back 16 is higher than the hip joints 21 and 23, the harness 62 preferably slants downwardly from the central bight 68 to the ends 64 and 66. This is clearly illustrated in FIG. 3, showing a side view of the device 28 as worn by a user 10.

A belt 70 is preferably provided to retain the harness 62 in its proper position and allow for adjustability of the device 28 for differently sized users 10. As shown in FIG. 2, the belt 70 preferably comprises two parts, firstly a strap 110 which extends completely around the waist 14 of user 10 and which is fastened at its ends by buckle 112. Secondly, a padded portion 108, preferably wider than strap 110, is provided to increase the comfort of user 10.

Padded portion 108 preferably comprises resilient foam rubber covered by a fabric, the belt strap 110 preferably being attached to the padded portion by means of rivets or by sewing. The belt strap 110 is preferably attached to the outward facing side of padded portion 108, with the padded portion 108 contacting the body of the user.

As shown in FIG. 2, the most rearward portion of the central bight 68 of harness 62 has an extension 90 extending upwardly from the central bight 68 of harness 62. The extension 90 is preferably integrally formed as a part of harness 62 from the same rigid, thermoplastic material as the harness 62.

The upward extension 90 of central bight 68 engages the lower back of 16 of user 10, as shown in FIGS. 3 and 5. Since the integrally formed harness 62 and extension 90 are preferably comprised of a rigid thermoplastic material, the engagement of extension 90 against the lower back 16 provides back support to the user 10 during use of the device 28.

The upward extension 90 is attached to the belt 70 as shown in FIG. 3. As shown in FIG. 2, the most rearward portion of the padded portion 108 of belt 70 is preferably wider than the forward most portions of the padded portion 108. The width of the rearward portion of padded portion 108 is preferably substantially the same as the height of the upward extension 90 of bight 68. The upward extension 90 is preferably fastened to belt 70 so as to substantially prevent motion of the harness 62 vertically and laterally relative to belt 70.

One preferred method of attaching the rearward portions of belt 70 to upward extension 90 is by the use of rivets or bolts. In this case, holes are preferably provided in both the upward extension 90 and the rearward portion of belt 70 to accommodate the rivets or bolts. Three holes 92, 94 and 96 are shown in FIG. 2 on the upward extension 90, which line up with holes 98, 100 and 102, respectively, formed in belt 70. FIG. 5 illustrates rivets 118, 120 and 122 provided through these holes to join the extension 90 and belt 70.

To allow the harness 62 to slope downwardly from the lower back 16 to the hip joints 21 and 23 of the user, the device 28 is preferably provided with straps 72 and 74 extending between belt 70 and hinge plates 30 and 32, respectively. These straps 72 and 74 are preferably adjustable in length so that the device 28 may be comfortably worn by different users 10 having different distances between the waist 14 and the hip joint 21 or 23. As shown in FIG. 2, the straps 72 and 74 are adjustable by means of adjusting buckles 76 and 78, by which the lengths of the straps 72 and 74 may be altered.

The straps 72 and 74 are preferably attached to the insides of ends 64 and 66 of harness 62 and the outward side of belt 70 by means of bolts or rivets provided through holes in the straps and belt. FIG. 2 illustrates right strap 74 attached to right end 66 by means of rivet 80. FIG. 2 also shows the upper ends of straps 72 and 74 being provided with holes 82 and 84, to line up with holes 86 and 88, respectively, of belt 70. A rivet or bolt 114 is preferably provided through holes 84 and 88, and a rivet or bolt 104 (shown in FIGS. 1, 3 and 4) is preferably provided through holes 82 and 86. These straps 72 and 74 are preferably able to swivel about the points of attachment to harness 62 and belt 70, to aid in adjusting to differently sized users.

The straps 72 and 74 and the extension 90 of bight 68 also assist in maintaining the position of the hinge plates 30 and 32 during use of device 28. As the user's leg forces pivot arm 34 to pivot about its pivot axis, the elastic band 56 is stretched. This produces a force on hinge plate 30 directed downwardly and rearwardly of hinge plate 30. To counteract this force, during rearward motion of the leg, the extension 90 on bight 68 exerts a forwardly directed force on the lower back 16 of the user 10 and straps 72 and 74 exert an upwardly directed force on hinge plates 30 and 32.

A preferred method of using the exercise device 28 for exercising the muscles of the buttocks 18 is now described in reference to the drawings.

Figure 4:
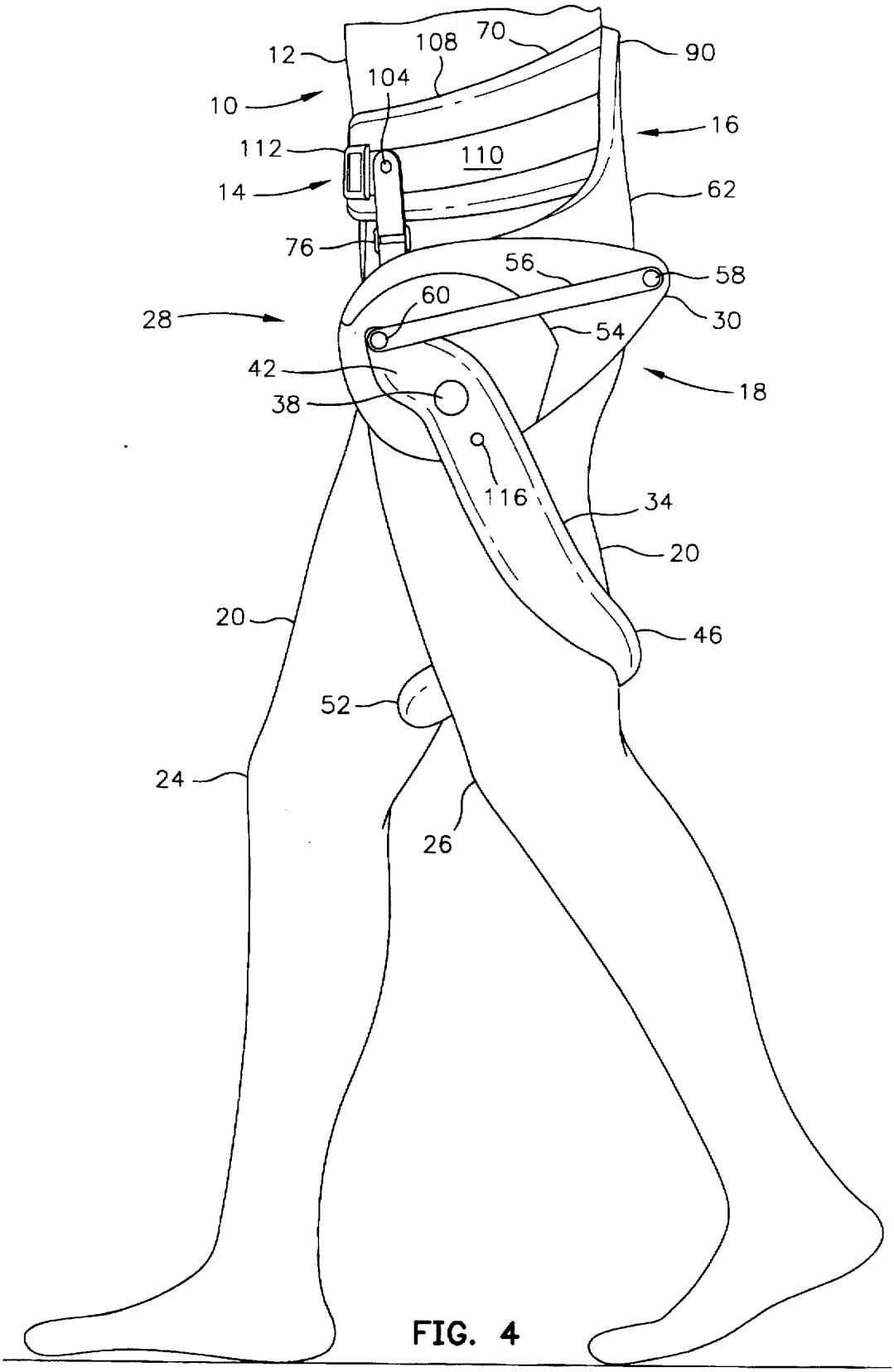
FIG. 4 is a side view similar to FIG. 3, with the left leg being at a second position.

FIGS. 3 and 4 show the full range of motion of the left leg 20 of user 10 during walking. For convenience, a description of the method of use relative to the right leg 22 is omitted from this discussion.

FIG. 3 illustrates the user 10 wearing the device 28, with the left leg 20 being at a first position during normal walking motion. FIG. 3 illustrates the position of left leg 20 immediately after user 10 has stepped forward with left leg 20. In this position, the engagement hook 50 of the left pivot arm 34 is in engagement with the back of left leg 20, the engagement hook 50 exerting at least some biasing force forwardly against the rear of left leg 20.

Therefore, the elastic band 56 must be at least partially stretched when left leg 20 is in the position shown in FIG. 3, since when elastic band 56 is completely relaxed, no biasing force will be produced and exerted against leg 20 by the pivot arm 34.

After the user 10 steps forward with left leg 20, the left leg 20 begins to pivot rearwardly about the left hip joint 21 as the right leg 22 comes forward.

FIG. 4 illustrates substantially the maximum degree to which the left leg 20 may pivot rearwardly about the left hip joint 21 of the user 10 during normal walking movement. In the position shown in FIG. 4, the right leg 22 has stepped forward while the user 10 is pushing back on the left leg 20. In this position, the biasing force produced by the elastic band 56 is at a maximum since the pivot arm 34 is at the position of maximum rearward pivoting relative the hinge plate 30. The elastic 56 is shown as being longer in FIG. 4 than in FIG. 3, meaning it is more stretched in FIG. 4.

In order to swing the left leg rearwardly from the position shown in FIG. 3 to that shown in FIG. 4, the muscles of the buttocks 18 contract. However, the rearward pivoting of the left leg 20 is resisted by the forwardly directed biasing force produced by the stretching of the rubber band 56 and exerted by pivot arm 34. Therefore, the muscles of the buttocks 18 must overcome this biasing force to pivot the left leg 20 rearwardly. The additional exertion of the buttocks 18 in overcoming the biasing force preferably results in strengthening of the muscles in the buttocks 18, which preferably results in firming and shaping of these muscles.

Therefore, the device 28 shown in the drawings provides an effective means of exercising the muscles of the buttocks 18, preferably during normal walking motion of the user 10. However, it is to be understood that it is not necessary for the user 10 to walk while wearing device 28 in order to derive a benefit. Any form of movement whereby the legs are pivoted rearwardly is sufficient.

Two alternate exercises for exercising muscles of the buttocks 18 are "leg raises" and "lunges". To perform leg raises, the user is supported on both hands and the knee of one leg. The other leg is preferably kept straight and raised from the floor. The exercise comprises pivoting the raised leg upwardly against a downwardly directed biasing force exerted by device 28. This movement is equivalent to user 10 pivoting the leg rearwardly while standing.

In lunges, the user 10 wearing device 28 steps forward with one leg while keeping the other leg stationary. The stationary leg pivots rearwardly about the hip joint during the lunging motion.

Further, the exercise device of the present invention can be used on its own or in combination with other exercise equipment. For example, the device may be used to exercise the buttocks while the user is using a walking machine, stair climber or cross-country skiing simulator. This allows more muscles to be exercised simultaneously and provides extra conditioning for the muscles of the buttocks.

The exercise device 28 illustrated in the drawings is preferably adaptable for use in exercising the thighs and arms of a user 10.

To exercise the thighs, the biasing mechanism is reversed to exert a rearwardly directed biasing force, which opposes pivoting of the leg 20 or 22 forwardly about the hip joint 21 or 23.

The biasing force produced by the biasing mechanism may be reversed in a number of ways. The simplest way to reverse the direction of the biasing force is to secure device 28 to user 10 with extension 90 on bight 68 at the front of user 10 and buckle 112 of belt 70 at the user's lower back 16. In other words, the device 28 is secured to the user 10 "backwards" relative to the configuration shown in FIG. 1.

In this backward configuration, engagement hook 50 engages the front of the user's right leg 22 between the right hip joint 23 and right knee 26. Similarly, engagement hook 52 engages the front of the user's left leg 20 between the left hip joint 21 and left knee 24.

In the alternative, an additional support pin 116 may be provided on the left pivot arm 34 below pivot pin 38. If instead of being stretched between support pins 58 and 60, elastic 56 is stretched between support pins 58 and 116, the biasing force will be opposite that produced when elastic 56 is stretched between support pins 58 and 60.

With the biasing force reversed using a third support pin 116, the device 28 is worn by the user 10 as shown in FIG. 1, with the exception that engagement hook 50 engages the front of the left leg 20 between the left hip joint 21 and left knee 24, and engagement hook 52 engages the front of right leg 22 between the right hip joint 23 and right knee 26.

If the biasing force is reversed using a third support pin 116, it is preferred that engagement hooks 50 and 52 be shaped to comfortably engage the fronts of legs 20 and 22, respectively. This may be done in a number of ways. For example, the second end 46 of pivot arm 34 may be detachable, allowing the substitution of another second end 46 adapted to engage the front of left leg 20. Alternatively, pivot pins 38 and 40 may be removable, allowing pivot arms 34 and 36 to be exchanged, with pivot arm 34 secured to right hinge plate 32 and pivot arm 36 secured to left hinge plate 30. This would produce the same effect as securing device 28 to user 10 in a backward configuration, as discussed above.

The thighs are exercised by pivoting the legs forwardly, opposite the rearwardly directed biasing force. This may be done by any of the exercise methods discussed above in reference to exercising muscles of the buttocks, all of which comprise forward and rearward pivoting of the legs about the hip joints. In addition, the user 10 may perform leg raises while lying face up comprising alternately or simultaneously raising legs 20 and 22 against the downwardly directed biasing force.

To exercise the muscles of the arms using device 28, the direction of the biasing force is preferably reversible. Methods of reversing the biasing force discussed above in reference to exercising the thigh muscles may be used, with the provision of a third support pin 116 being most preferred.

Two types of arm exercises may be performed using device 28. Firstly, device 28 may be secured to the user 10 in the configuration described above with reference to thigh exercises, with elastic 56 stretched between support pins 58 and 116. However, instead of pivoting legs 20 and 22 forwardly, user 10 holds engagement hooks 50 and 52 with his or her hands, and pulls upwards toward the chest, pivoting the forearm about the elbow.

To perform arm exercises wherein the arms are pushed away from the chest and straightened, the elastic 56 is preferably stretched between biasing pins 58 and 60 as shown in FIG. 1. However, instead of engagement hooks 50 and 52 engaging the rear of legs 20 and 22, the pivot arms 34 and 36 are substantially parallel to elastic 56 and are directed forwardly of the user's body, not engaging legs 20 and 22. In this configuration, the user 10 pushes downward and away from the chest on engagement hooks 50 and 52, with arms 34 and 36 preferably being pushed downward until engagement hooks 50 and 52 engage the fronts of legs 20 and 22, respectively.

To adapt the device 28 for arm exercises, the engagement hooks 50 and 52 are preferably replaced by hand grips or a cross bar extending between second ends 46 and 48 and preferably rigidly joining the arms 34 and 36 into a rigid U-shaped member. In the alternative, hooks 50 and 52 may serve both as hand grips and leg engagement devices, or pivot arms 34 and 36 may be adapted to receive a cross bar extending between them. This may be done, for example, by providing holes in second ends 46 and 48 and/or hooks 50 and 52, through which a cross bar may be inserted.

It is to be understood that, although device 28 has been illustrated in the drawings as having a certain configuration of biasing mechanism with elastic 56 and support pins 58, 60 and 116, alternate configurations are possible. For example, it may be preferred to provide additional or alternate support pins so that the device 28 may be used to exercise a different combination of muscle groups, or to more effectively exercise the buttocks, thighs or arms. Further, flange 54 may be eliminated or have its configuration changed to alter the degree to which pivot arm 34 may rotate about hinge plate 30.

Although the invention has been described in connection with certain preferred embodiments, it is not intended that it be limited thereto. Rather, it is intended that the invention cover all alternate embodiments as may be within the scope of the following claims.

The embodiments of the invention in which an exclusive property or privilege is claimed are defined as follows:

1. A body mounted muscle exercise apparatus for humans, said apparatus comprising:

a harness adapted to at least partially encircle the waist of the user;

adjustable means for removably securing said harness to the user;

hinge plate means secured to said harness at a position adjacent to each hip of the user;

an elongated, substantially rigid, sanitary arm pivotably coupled at one end to each said hinge plate means;

means connected between each said hinge plate means and said elongated arm for biasing said arm to oppose movement of a body extremity of the user only in one direction with respect to said apparatus, the biasing strength of said biasing means being variable; and means at the opposite end of said elongated arm for engaging a body extremity to be exercised by exerting force against the urging of said biasing means, said engaging means functioning with respect to the user's extremity without impeding normal bending of that extremity at any of its joints, said hinge plate means, unitary arm and biasing means adjacent one hip of the user functioning independently of said hinge plate means, unitary arm said biasing means adjacent the other hip of the user;

whereby selective predetermined muscles of the user can be exercised by moving a body extremity against the resistive force of said biasing means.

2. The exercise apparatus recited in claim 1, wherein said hinge plate means comprises a hinge plate mounted on each side of said harness outwardly of the user's hip.

3. The exercise apparatus recited in claim 2, wherein said harness has first and second ends, each said hinge plate being connected to one of said ends, said apparatus further comprising adjustable length straps coupled between said harness ends and said securing means to selectively vary the distance between said securing means and said hinge plate;

whereby different size users can use said apparatus at proper orientation with respect to the user's body while maintaining comfort on the part of the user.

4. The exercise apparatus recited in claim 2, wherein said unitary arms are pivotably coupled to said hinge plates by respective pivot pins, each said pivot pin having a pivot axis, said harness being adjustable so that said pivot axis is substantially coincident with the axis of rotation of the user's hip joint.

5. The exercise apparatus recited in claim 1, wherein said harness is formed with an upwardly extending central bight to provide support to the lower back of the user of the apparatus.

6. The exercise apparatus recited in claim 1, wherein said unitary arm extends longitudinally away from and generally parallel to said hinge plate, said engaging means comprising a generally laterally extending body extremity engaging element.

7. The exercise apparatus recited in claim 1, wherein said biasing means is selected from the group consisting of springs and resilient elastic members.

8. The exercise apparatus recited in claim 1, wherein said unitary arm and said body extremity engaging means are particularly configured to engage the user's leg and bias against rearward motion of that leg, thereby exercising the muscles of the user's buttocks.

9. A method for exercising selected muscles of humans, comprising the steps of:

providing harness means adjustably adapted to encircle the waist of the user, the harness means having elongated substantially rigid, unitary arms extending therefrom and pivotably coupled to the harness means;

selecting bias means of the strength desired;

connecting the bias means to the harness means and to the pivot arms a a first position so as to independently bias the pivot arms in a single preselected direction;

mounting the harness means to the user;

positioning each pivot arm to engage one body extremity;

resisting by the bias means motion of the body extremity against the preselected direction; and permitting normal bending of the body extremity at any of its joints;

whereby movement of the engaged body extremity against the resistance of the biased pivot arms exercises the selected muscles of the user.

10. The method recited in claim 9, wherein the body extremity is the user's leg, the motion resisted is natural rearward motion of the leg while walking whereby the user's buttocks muscles are exercised.

11. The method recited in claim 10, and comprising the further step of moving the bias means connection on said pivot arm to an alternative position on said pivot arms to bias the pivot arms in the opposite direction.

12. A body mounted muscle exercise apparatus for humans, said apparatus comprising:

a harness adapted to at least partially encircle the waist of the user;

adjustable means for removably securing said harness to the user, said adjustable securing means comprising a belt which encircles the waist of the user and is adjustably removably securable to the user, said belt and said harness being secured together whereby said harness is removably secured to the user by said belt;

at least one hinge plate means secured to said harness at a position adjacent to a hip of the user;

an elongated, substantially rigid, unitary arm pivotably coupled at one end to said hinge plate means;

means connected between said hinge plate means and said elongated arm for biasing said arm to oppose movement of a body extremity of the user in one direction; and means at the opposite end of said elongated arm for engaging a body extremity to be exercised by exerting force against the urging of said biasing means, said engaging means functioning with respect to the user's extremity without impeding normal bending of that extremity at any of its joints;

whereby selective predetermined muscles of the user can be exercised by moving a body extremity against the resistive force of said biasing means.

13. A body mounted muscle exercise apparatus for humans, said apparatus comprising:

a harness adapted to at least partially encircle the waist of the user;

adjustable means for removably securing said harness to the user;

at least one hinge plate means secured to said harness at a position adjacent to a hip of the user;

an elongated, substantially rigid, unitary arm pivotably coupled at one end to said hinge plate by a pivot pin;

means connected between said hinge plate and said elongated arm for biasing said arm to oppose movement of a body extremity of the user in one direction, said biasing means comprising an elongated elastic member connected at one end to said hinge plate means; and means at the opposite end of said elongated arm for engaging a body extremity to be exercised by exerting force against the urging of said biasing means, said engaging means functioning with respect to the user's extremity without impeding normal bending of that extremity at any of its joints;

said unitary arm comprising a first support pin on one side of and spaced from said pivot pin, and a second support pin on the opposite side of and spaced from said pivot pin, said biasing means being selectively connected to one of said first and second support pins, said unitary arm being selectively biased in either direction about said pivot pin depending upon which support pin to which said elastic member is connected from said hinge plate means;

whereby selective predetermined muscles of the user can be exercised by moving a body extremity against the resistive force of said biasing means.

* * * * *